US007134644B2

(12) United States Patent
Wallner

(10) Patent No.: US 7,134,644 B2
(45) Date of Patent: Nov. 14, 2006

(54) COMPRESSED AIR BALANCER

(76) Inventor: Manfred Joseph Wallner, Tellstrabe 20, 42657 Solingen (DE)

( * ) Notice: Subject to any disclaimer, the term of this patent is extended or adjusted under 35 U.S.C. 154(b) by 0 days.

(21) Appl. No.: 10/947,081

(22) Filed: Sep. 22, 2004

(65) Prior Publication Data

US 2005/0120713 A1 Jun. 9, 2005

(51) Int. Cl.
*B66D 1/00* (2006.01)

(52) U.S. Cl. ..... 254/331

(58) Field of Classification Search ..... 254/331, 254/360, 383

See application file for complete search history.

(56) References Cited

U.S. PATENT DOCUMENTS

| | | | | |
|---|---|---|---|---|
| 3,286,989 | A * | 11/1966 | Bangerter et al. | 254/331 |
| 3,428,298 | A * | 2/1969 | Powell | 254/331 |
| 3,481,582 | A * | 12/1969 | Ulbing | 254/331 |
| 3,547,155 | A * | 12/1970 | Ulbing | 137/625.21 |
| 3,633,875 | A | 1/1972 | Workman | 254/168 |
| 3,933,388 | A * | 1/1976 | Conboy | 294/64.1 |
| 4,449,446 | A | 5/1984 | Degnan et al. | 92/146 |
| 4,984,508 | A | 1/1991 | Muller | 92/13.5 |
| 5,370,367 | A * | 12/1994 | Zaguroli, Jr. | 254/360 |
| 6,334,607 | B1 * | 1/2002 | Kulhavy | 267/64.12 |
| 2001/0022358 | A1 | 9/2001 | Heun et al. | 254/267 |

FOREIGN PATENT DOCUMENTS

| | | |
|---|---|---|
| DE | 2 155 273 | 5/1973 |
| DE | G 94 17 852.6 | 11/1994 |
| FR | 1.514.445 | 2/1967 |
| FR | 71.24622 | 3/1972 |

* cited by examiner

*Primary Examiner*—Emmanuel M Marcelo
(74) *Attorney, Agent, or Firm*—Grossman Tucker Perreault & Pfleger, PLLC

(57) ABSTRACT

The invention concerns a compressed air balancer (1) for raising, holding and lowering a load, comprising a cable drum (4) which is rotatable and displaceable along its axis of rotation for rolling up and unrolling a cable holding the load, a housing which preferably includes a cylindrical casing (2) and two end closure covers (3), a piston (7) which is subjected to the effect of gas pressure and which is displaceable axially in the housing; and a ball thread transmission which includes a ball rolling spindle (5) and a ball nut (6) and which converts an axial movement of the piston (7) into a rotary movement and axial movement of the cable drum (4). The compressed air balancer (1) is distinguished in that an external running surface of the piston (7) is formed by an internal surface (12) of a tube (8) which is fitted in the form of an internal sleeve into the cylindrical casing (2). Preferably a carbon fiber tube is used as the tube (8).

11 Claims, 4 Drawing Sheets

COMPRESSED AIR BALANCER

The invention concerns a compressed air balancer for raising, holding and lowering a load.

A compressed air balancer usually has a rotatable cable drum which is arranged displaceably along its axis of rotation. A cable from which the load to be held hangs is unrolled or rolled up, by rotation of the cable drum. The cable drum is arranged in a housing which preferably includes a cylindrical casing and two end closure covers. In addition, disposed in the housing is a piston which is subjected to the action of gas pressure and which can be displaced axially in the housing. A ball thread transmission which is also disposed in the housing and which includes a ball rolling spindle and a ball nut converts the axial movement of the piston into a rotary and axial movement of the cable drum.

In order for example to raise the load hanging from the cable, the gas pressure on the piston is increased, whereby the piston is axially moved. That results in a rotary movement of the cable drum so that the cable is rolled up. If in contrast the load is to be held at a height, the gas pressure applied to the piston and the force produced by the force of gravity acting on the load are in a condition of force equilibrium. The load thus floats or hovers on a gas or air cushion. By virtue of the compressibility of the gas the load can be moved upwardly or downwardly from its equilibrium position by hand within a certain range, so that in return for that, the gas pressure acting on the piston has to be re-set. That facilitates the work involved when installing and fitting parts in machines as both hands are free and it is easily possible to calibrate the part which is to be installed.

In the housing the piston forms a boundary of a chamber which is variable in volume and into which a compressed medium, for example air, can be passed. If the load hanging from the cable is to be held for example at a constant height then the axial position of the piston in the housing and thus also the volume in the chamber have to remain constant. Constancy of volume over a prolonged period of time requires the chamber to be sealed off in as leakage-free fashion as possible. In that respect the seal between the piston and its running surfaces is found to be critical.

EP 1 136 423 A1 discloses a compressed air balancer in which a cylindrical piston is arranged displaceably in a hollow cylinder. A piston ring or sealing ring is provided between the piston and the hollow cylinder. In order to provide as leakage-free sealing integrity as possible the sealing ring is under stress and presses against the running surface of the piston.

The sealing ring which presses against the running surface means that the movement of the piston in the cylinder suffers severely from friction. Good sealing integrity in respect of the chamber and a certain ease of mobility on the part of the piston are in a stressing area. Thus generally good sealing integrity is achieved at the expense of easy mobility and vice-versa.

Easy mobility of the piston is important in order to minimize a so-called initial break-away moment. If for example the piston is to be moved out of a stopped condition, the difference between static friction and sliding friction means that an additional moment or an additional force is necessary to set the piston in motion. An excessively high initial break-away moment is in conflict with smooth and gentle displacement of the load out of the stopped condition and is consequently to be avoided as far as possible.

The object of the present invention is to provide a compressed air balancer which on the one hand has a well-sealed compressed gas chamber and with which smooth and gentle displacement of the load suspended from the cable is possible.

That object is attained by the features of claim 1. The external running surface of the piston is formed by the internal surface of the tube which is fitted in the form of an internal sleeve into the cylinder casing. The tube which for example is in the form of a carbon fiber tube, a ceramic tube or a glass tube, has preferably a particularly smooth surface so that the friction between the piston and the external running surface or between the sealing ring and the external running surface is very low. That applies equally in regard to static friction and sliding friction, in which respect that also markedly reduces the difference between sliding friction and static friction, which crucially influences the magnitude of the break-away moment.

In production of the compressed air balancer, a steel casing can be turned out to a suitable fit and the internal tube comprising a material with particularly good surface properties can be fitted therein.

In a preferred embodiment the rotational truth tolerance of the tube is less than 0.005 mm. It has proven to be particularly desirable if the rotational truth tolerance is less than 0.001 mm.

In a preferred embodiment provided between the tube and the piston is at least one external piston ring which is subjected to the effect of gas pressure from an inside of the piston ring. That causes the piston ring to be pressed against the tube by means of gas pressure. Preferably the gas pressure which bears against the piston is used in that respect. Accordingly the pressure with which the piston ring is pressed against the carbon fiber tube and the pressure in the chamber which is delimited by the piston and which is to be sealed off as well as possible are in a given ratio. The greater the pressure in the chamber, the correspondingly greater also is the pressure applied to the piston ring and therewith also the sealing integrity as between the piston and the carbon fiber tube.

Preferably the ball rolling spindle extends between the two laterally mounted closure covers. In that way the two closure covers can be easily braced relative to each other by way of the ball rolling spindle, whereby the cylindrical casing arranged between the closure covers is fixed in position. The ball rolling spindle which extends between the two closure covers also engages through the piston and the chamber.

Preferably, provided between the piston and the ball rolling spindle is at least one internal piston ring which is subjected to a gas pressure from an inside of the piston ring, as is also possible in the case of the external piston ring.

The internal and/or external piston ring can be of a substantially V-shaped ring cross-section. The ring cross-section includes two limbs which are arranged at an angle and which each have an open end and an end at which the two limbs come together. The open ends desirably bear against side walls of a piston groove while the two converging limbs at the respective other end bear against the carbon fiber tube or the ball rolling spindle respectively.

In order for a piston ring to be subjected to the action of gas pressure from its inside, the piston groove at an underside has a corresponding gas pressure opening. The piston groove and the piston ring bearing thereagainst from an annular pressure chamber in which the pressure obtaining there presses the ring against the corresponding running surface of the piston.

In a preferred embodiment the ball rolling spindle includes a spiral ball rolling track, wherein the ball rolling track is not provided in a region of the ball rolling spindle which forms an internal running surface of the piston. Therefore the internal running surface of the piston has a smooth cylindrical surface so that a spindle covering means between the piston and the ball rolling spindle is not necessary to provide good sealing integrity.

In order also to keep the internal running surface of the piston as friction-free as possible, the surface of the ball rolling spindle is ground. That makes it possible to achieve a particularly low level of surface roughness. In addition or alternatively the surface can also be rolled.

Preferably there is provided a cable guide housing having a guide cylinder which is arranged in coaxial relationship with the cable drum and at least one support ring which extends in the radial direction from the guide cylinder to the cylindrical casing of the housing. On the one hand the cable guide housing serves for centering the cable drum in the housing and to provide protection from the cable jumping off the cable drum. On the other hand the cable guide housing provides that both the cable drum and also the region of the ball rolling spindle, which forms the internal running surface of the piston, do not become contaminated by dust or other particles which can penetrate into the housing from the exterior through a cable exit opening of the compressed air balancer.

The invention is described in greater detail by means of an embodiment illustrated in the Figures in which.

Figure 1:
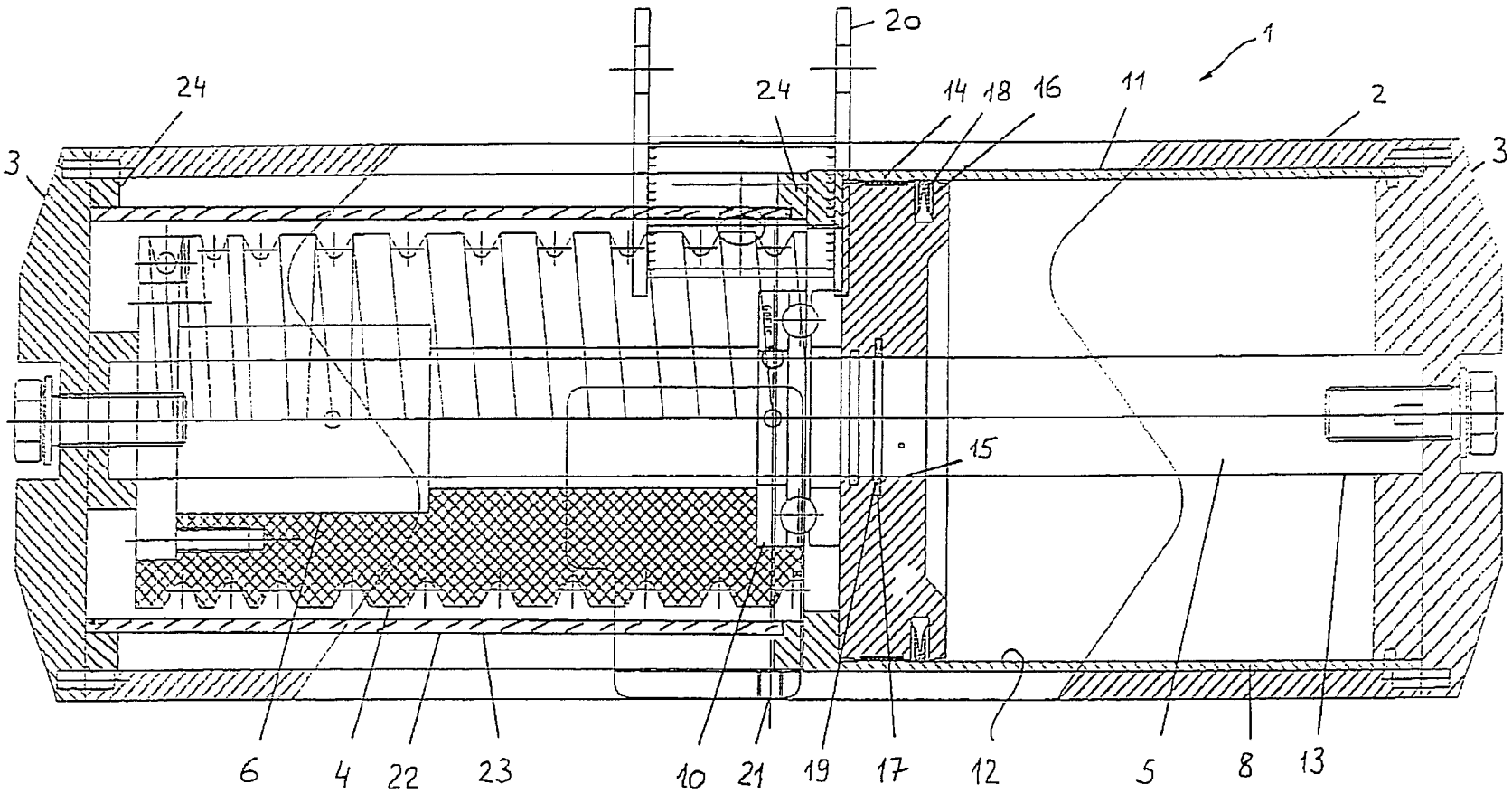
FIG. 1 shows a view in longitudinal section of a compressed air balancer.

FIG. 1 is a view in longitudinal section of a compressed air balancer 1. The compressed air balancer 1 includes a cylindrical casing 2 and laterally mounted closure covers 3. Disposed in the compressed air balancer 1 is a cable drum 4 which is rotatable and displaceable along its axis of rotation. An axial movement of the piston 7 is converted into a rotational movement and axial movement of the cable drum 4 by way of a ball thread transmission comprising a ball rolling spindle 5 and a ball nut 6.

The piston 7, together with the right-hand closure cover 3 shown in FIG. 1, a carbon fiber tube 8 and a part of the ball rolling spindle 5, delimits a chamber 9 into which a compressed medium, preferably compressed air, can be passed. When the chamber 9 is subjected to the effect of compressed air the piston 7 is displaced axially. In that situation it presses against the cable drum 4 by means of a ball thrust bearing 10 which permits a relative rotary movement between the piston 7 and the cable drum 4. By virtue of the co-operation of the stationary ball rolling spindle 5 and the ball nut 6 which is connected non-rotatably to the cable drum 4, the cable drum rotates about its own axis, due to the axial displacement.

The carbon fiber tube 8 bears with an external surface 11 against the cylindrical casing 2. An internal surface 12 of the carbon fiber tube forms an external running surface of the piston 7. The ball rolling spindle 5 which extends between the two closure covers 3 engages through the piston 7 and the chamber 9, the spindle 5 forming an internal running surface 13 for the annular piston 7.

Both at an outside 14 and also at an inside 15 the piston 7 has annular grooves 17 for accommodating piston rings 18, 19.

In order to suspend the compressed air balancer 1 in a guide rail or the like, a holder 20 is provided in the upper region of the compressed air balancer 1. A cable exit opening 21 is arranged in the lower region of the compressed air balancer.

The cable drum 4 is covered by a cable guide housing 22 which is arranged in coaxial relationship with the cable drum 4. The cable guide housing 22 has a guide cylinder 23 and support rings 24 which are arranged at its ends and which provide for centering in the cylindrical compressed air balancer 1.

Figure 2:
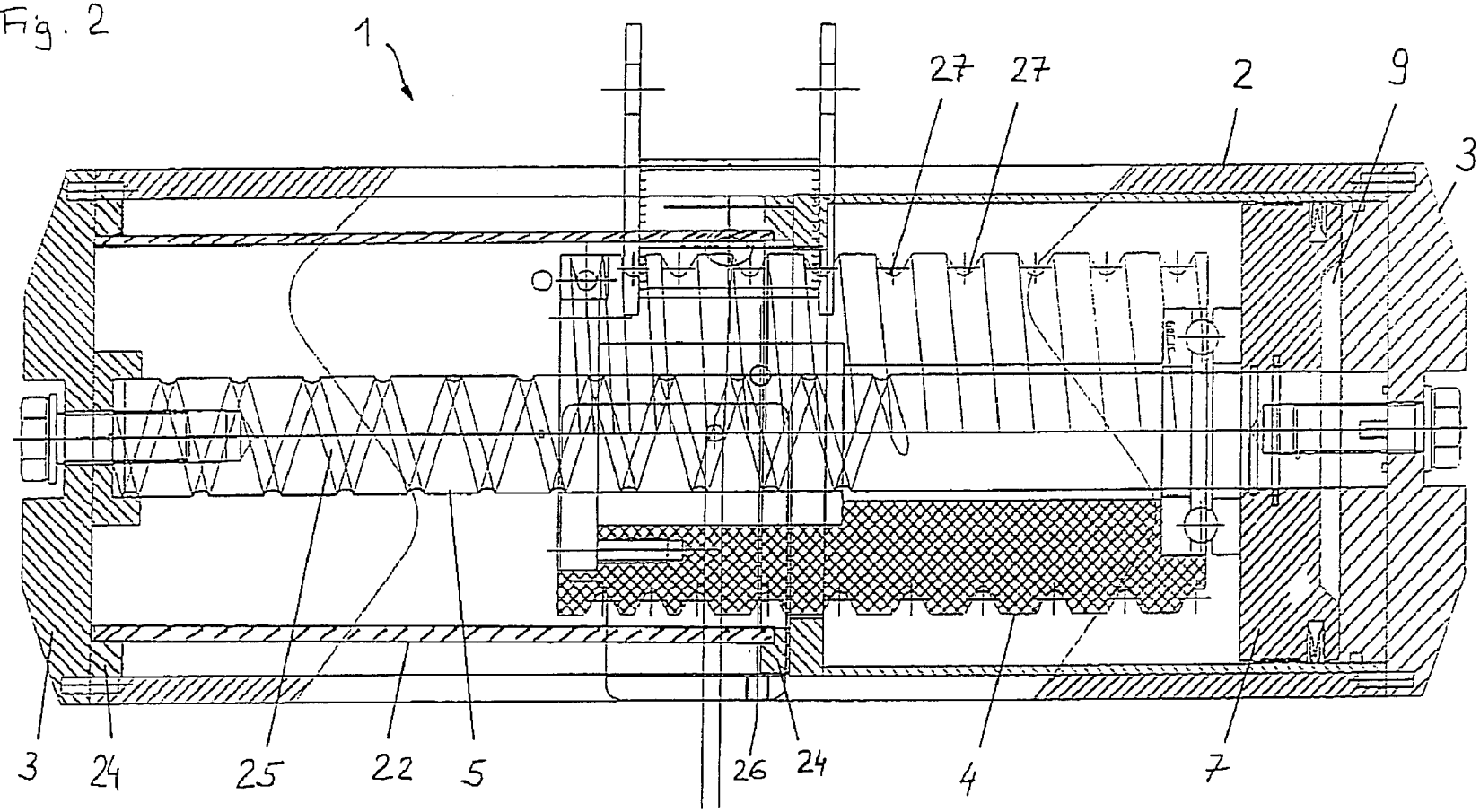
FIG. 2 shows the compressed air balancer of FIG. 1, a piston displaceable therein assuming a different position.

FIG. 2 shows the compressed air balancer 1 of FIG. 1, but now the piston 7 is in a condition of bearing against the right-hand closure cover 3. In a corresponding manner the cable drum 4 is now in a different axial position. It will be seen from FIG. 2 that a spiral ball rolling track 25 is provided in the ball rolling spindle, the track 25 extending over a part of the ball rolling spindle 5.

In the position of the piston 7 and the cable drum 4 as shown in FIG. 2, a cable 26 is unrolled to the maximum extent. When now compressed air is passed into the chamber 9 the piston 7 urges the cable drum 4 away in front to it, the cable drum 4 rotating by means of the ball thread transmission and winding up the cable 26. The spacing between two adjacent grooves 27 of the cable drum 4 corresponds exactly to the piston travel in one revolution of the cable drum 4. In that way, the cable 26 always issues from the compressed air balancer at the same location.

Figure 3:
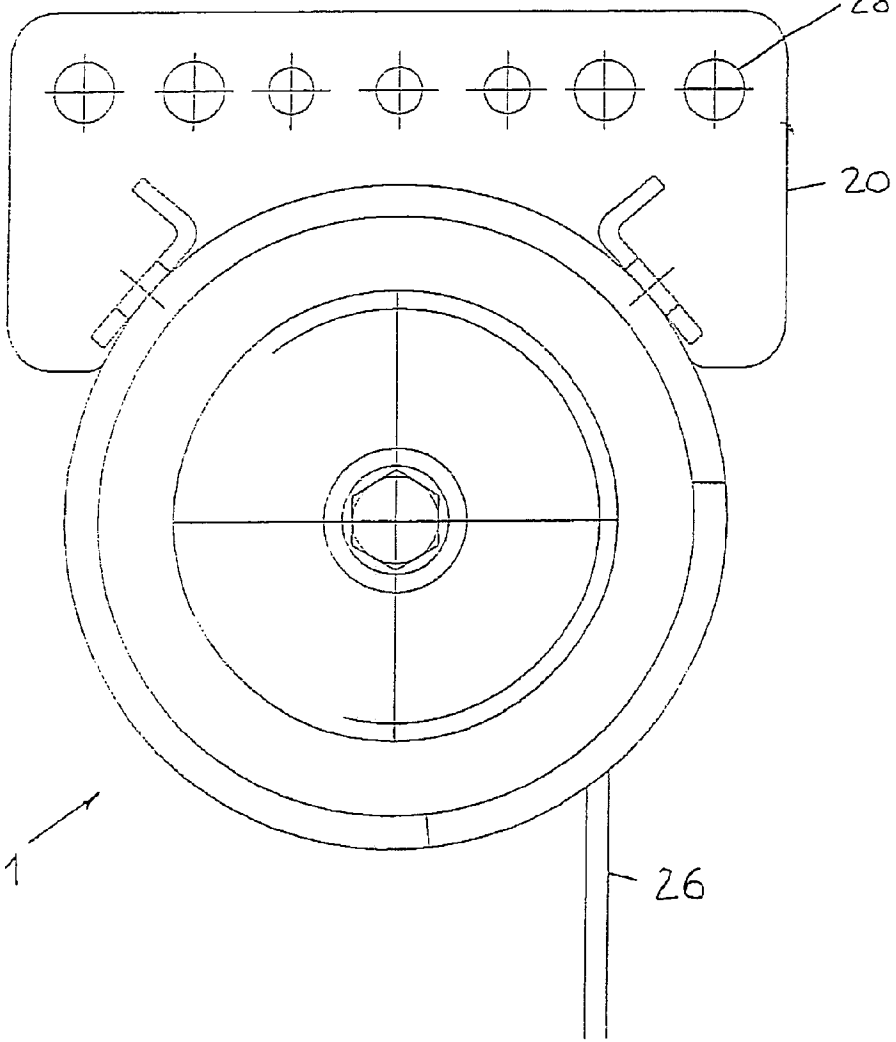
FIG. 3 shows a view taken along line III—III in the Figure.

FIG. 3 shows the compressed air balancer taken along line III—III in FIG. 1. It is possible to see the compressed air balancer 1 which is of circular cross-section and the holder 20 fixed thereto. The holder 20 has a plurality of passage openings 27 for fixing the compressed air balancer to a suspension arrangement (not shown here).

Figure 4:
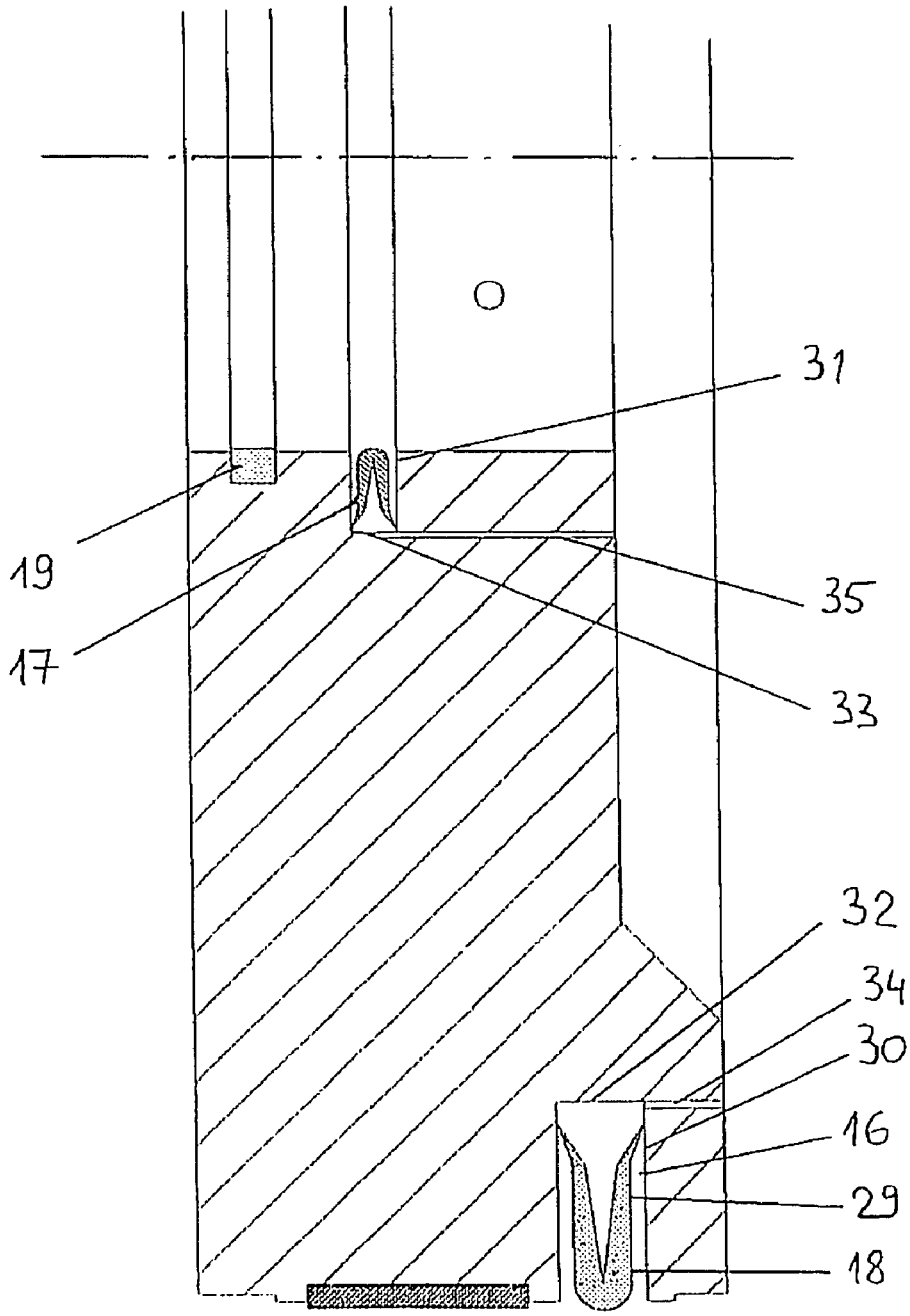
FIG. 4 shows the piston with a piston ring in detail.

FIG. 4 shows a part of the piston 7 with the piston rings 18, 19. The piston rings 18, 19 are of a substantially V-shaped ring cross-section. The ring cross-section has two diverging limbs 29 which bear against lateral walls 30, 31 of the ring grooves 16, 17. Opening at the bottom surfaces 32, 33 of each of the ring grooves 16, 17 is a respective passage 34, 35 which communicates the ring grooves 16, 17 with the chamber 9. Accordingly the pressure of the chamber 9 acts against a respective inside of the piston rings 18, 19 and urges the piston rings against the corresponding running surfaces.

LIST OF REFERENCES

1 compressed air balancer
2 cylindrical casing
3 closure cover
4 cable drum
5 ball rolling spindle
6 ball nut
7 piston
8 carbon fiber tube
9 chamber
10 thrust ball bearing
11 external surface
12 internal surface
13 internal running surface
14 outside
15 inside
16 piston ring groove
17 piston ring groove
18 piston ring
19 piston ring

20 holder
21 cable exit opening
22 cable guide housing
23 guide cylinder
24 support ring
25 cable rolling track
26 cable
27 groove
28 passage opening
29 limb
30 side wall
31 side wall
32 bottom side
33 bottom side
34 passage
35 passage

What is claimed is:

1. A compressed air balancer for raising, holding and lowering a load, comprising a cable drum which is rotatable and displaceable along its axis of rotation for rolling up and unrolling a cable holding the load, a housing which includes a cylindrical casing and two end closure covers, a piston which is subjected to the effect of gas pressure and which is displaceable axially in the housing; and a ball thread transmission which includes a ball rolling spindle and a ball nut and which converts an axial movement of the piston into a rotary movement and axial movement of the cable drum, characterized in that an external running surface of the piston is formed by an internal surface of a tube which is fitted in the form of an internal sleeve into the cylindrical casing and that provided between the tube and the piston is at least one external piston ring which is subjected to the effect of gas pressure from an inside of the piston ring to reduce friction between the piston ring and internal surface of the tube.

2. A compressed air balancer as set forth in claim 1 characterized in that the tube is in the form of a carbon fiber tube, a glass tube or a ceramic tube.

3. A compressed air balancer as set forth in claim 1 characterized in that the tube has a rotational truth tolerance of less than 0.005 mm.

4. A compressed air balancer as set forth in claim 1 characterized in that the ball rolling spindle extends between the two closure covers.

5. A compressed air balancer as set forth in claim 4 characterized in that provided between the piston and the ball rolling spindle is at least one internal piston ring which is subjected to the effect of gas pressure from an inside of the piston ring.

6. A compressed air balancer as set forth in claim 5 characterized in that the internal piston ring is of a substantially V-shaped ring cross-section.

7. A compressed air balancer as set forth in claim 1 characterized in that the ball rolling spindle includes a spiral ball rolling track, wherein the ball rolling track is not provided in a region of the ball rolling spindle, which forms an internal running surface of the piston.

8. A compressed air balancer as set forth in claim 7 characterized in that the surface of the internal running surface is ground.

9. A compressed air balancer as set forth in claim 7 characterized in that the surface of the internal running surface is rolled.

10. A compressed air balancer as set forth in claim 1 characterized in that there is provided a cable guide housing having a guide cylinder which is arranged coaxially with respect to the cable drum and at least one support ring which extends in the radial direction from the guide cylinder to the cylindrical casing of the housing.

11. A compressed air balancer as set forth in claim 1 characterized in that external piston ring is of a substantially V-shaped ring cross-section.

* * * * *

UNITED STATES PATENT AND TRADEMARK OFFICE

CERTIFICATE OF CORRECTION

PATENT NO. : 7,134,644 B2
APPLICATION NO. : 10/947081
DATED : November 14, 2006
INVENTOR(S) : Wallner It is certified that error appears in the above-identified patent and that said Letters Patent is hereby corrected as shown below:

Title Page: Item "(54)", Delete "COMPRESSED AIR BALANCER" and insert --BALANCER DRIVEN BY PRESSURIZED AIR--.

Column 1, Line 2, Delete "COMPRESSED AIR BALANCER" and insert, --BALANCER DRIVEN BY PRESSURIZED AIR--.

Signed and Sealed this

Thirtieth Day of January, 2007

JON W. DUDAS
*Director of the United States Patent and Trademark Office*